United States Patent [19]

Sindlinger

[11] 4,432,725

[45] Feb. 21, 1984

[54] SUBMINIATURE FLASHLAMP MOUNT DESIGN

[75] Inventor: Ronald E. Sindlinger, Muncy, Pa.

[73] Assignee: GTE Products Corporation, Stamford, Conn.

[21] Appl. No.: 380,592

[22] Filed: May 20, 1982

[51] Int. Cl.[3] ..... F21K 5/02
[52] U.S. Cl. ..... 431/362
[58] Field of Search ..... 431/358, 362

[56] References Cited

U.S. PATENT DOCUMENTS

| | | | |
|---|---|---|---|
| 3,602,619 | 8/1969 | Vandertas et al. | 431/362 |
| 4,059,389 | 11/1977 | Armstrong et al. | 431/362 |
| 4,348,173 | 9/1982 | English et al. | 431/362 |

*Primary Examiner*—Carroll B. Dority, Jr.
*Attorney, Agent, or Firm*—Thomas H. Buffton

[57] ABSTRACT

A photoflash lamp has an envelope containing a filamentary combustible material in a combustion-supporting atmosphere and is positioned adjacent an ignition means having a pair of electrical conductors sealed into one end of the envelope and bent to form loops within the envelope whereon a covering of primer material is disposed.

12 Claims, 4 Drawing Figures

SUBMINIATURE FLASHLAMP MOUNT DESIGN

TECHNICAL FIELD

This invention relates to subminiature photoflash lamps and more particularly to subminiature photoflash lamps having an ignition means of improved configuration.

BACKGROUND ART

Generally, photoflash lamps responsive to high voltage pulse potentials, such as several hundred to several thousand volts available from a piezoelectric crystal for example, employ a bridge of primer material. Such flashlamps usually have a tubular glass envelope which is tipped off at one end and formed by a press seal at the opposite end. A pair of spaced electrical conductors are embedded into and pass through the press seal of the envelope and terminate therein in an ignition structure which usually includes a glass bead or reservoir of some type bridging the ends of the spaced electrical conductors. A primer material essentially covers, or at least extends between, the ends of the electrical conductors. Also, a filamentary combustible material is located adjacent the primer material within the envelope and a combustion-supporting gas under several atmospheres of pressure is contained within the envelope.

In operation, a high voltage pulse potential applied to the electrical conductors causes an electrical breakdown of the primer material. This breakdown or deflagration ignites the shredded filamentary combustible material to provide the desired light source.

Although the above-described photoflash lamp structures have been and still are utilized with varying degrees of success, there are a number of problem areas which are familiar to those skilled in the art. Perhaps the most prevalent of all problems with such structures is the tendency for the shredded combustible material to short-circuit the electrical conductors and deleteriously effect the desired electrical breakdown of the primer material.

An example of a known prior art lamp structure which attempts to overcome the above-described short circuiting conditions is set forth in U.S. Pat. No. 4,059,389, assigned to the Assignee of the present application. Therein, a pair of electrical conductors are sealed into one end of an envelope and the ends of the conductors within the envelope are melted and rounded to provide relatively smooth terminations. Thereafter, a layer of electrical insulating material, such as glass frit, is deposited onto the rounded ends of the electrical conductors and a portion of the conductors adjacent thereto. Then, a portion of the insulating material is removed from the rounded portions of the electrical conductors, and a coating of primer material is affixed to the rounded ends of the conductors covering both the insulated and the non-insulated portions.

Another known lamp structure utilizing a primer material within an envelope which also contains shredded combustible material and a combustion-supporting atmosphere is set forth in U.S. Pat. No. 4,097,220 issued to Cote et al. Therein, a pair of electrically conductive leads are positioned within an envelope and bent in a manner such that the ends thereof are in a single plane opposing one another. Thereafter, the ends and an adjacent portion of each of the electrically conductive leads are surrounded with a primer material.

One of the numerous problems associated with prior known high voltage flashlamp construction is that such structures are not particularly suitable to the newer subminiature photoflash arrays. Therein, the leads within the envelope must be relatively short because of the limited length of the envelope or the limited total lamp length. However, the shorter leads required by the shorter lamp present a whole list of additional problems. For example, the shortened leads within the envelope exhibit a tendency to seal over or become covered with glass during the envelope sealing process. Moreover, the shortened leads exhibit little, if any, resistance to glass flow which occurs during the above-mentioned envelope sealing. Further, the sharp and irregular cut of the shortened and trimmed wires easily penetrates the normal primer coating causing the shredded combustible material to short-circuit the primer material resulting in an inoperative lamp.

SUMMARY OF THE INVENTION

An object of the present invention is to provide an enhanced photoflash lamp. Another object of the invention is to provide a photoflash lamp having an improved ignition means. A still further object of the invention is to provide an improved flashlamp having a pair of electrical conductors formed in a manner to enhance the ignition means thereof.

These and other objects, advantages and capabilities are achieved in one aspect of the invention by a photoflash lamp having a glass envelope containing a filamentary combustible material, a combustion-supporting atmosphere and an ignition means wherein a pair of electrical conductors are sealed into one end of the envelope, bent to form a lamp having the end thereof embedded into the envelope and a primer material bridging the loops of each one of the pair of electrical conductors.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
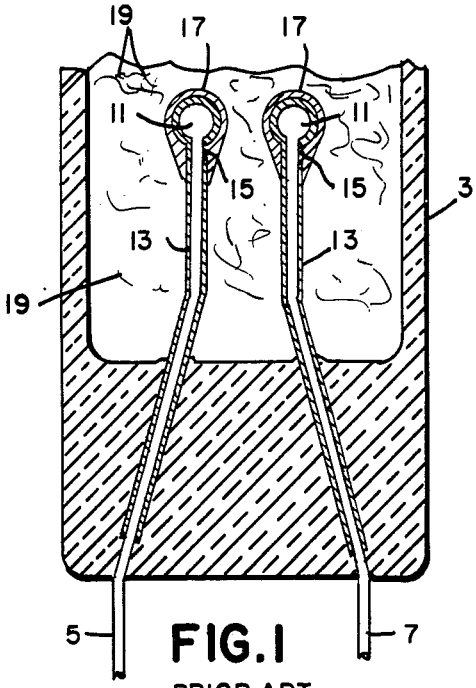
FIG.1 PRIOR ART
FIG. 1 is an illustration of a photoflash lamp having relatively long inner leads with rounded ends as set forth in the prior art.

Referring to the drawings, FIG. 1 illustrates a photoflash lamp of the prior art. Typically, the photoflash lamp has an envelope 3 with an internal diameter of less than about one-half inch and an internal volume of less than about one cubic centimeter. A pair of electrical conductors 5 and 7 respectively are sealed into one end 9 and extend inwardly to the envelope 3. A rounded end 11 is provided on each one of the conductors 5 and 7, and a coating of electrical insulating material 13 covers most of the conductors 5 and 7 within the envelope 3. However, a portion 15 of each of the conductors 5 and 7 is not coated with the insulating material 13. Thereafter, a layer of primer material 17 is affixed to the insulating material 13 in the vicinity of the rounded end 11 of each of the conductors 5 and 7 as well as the portion 15 whereon insulating material 13 is not present. Additionally, combustible material 19 is disposed immediately adjacent the rounded end 11 of the conductors 5 and 7 while an atmosphere of combustible gas is enclosed within the envelope 3.

As can readily be seen, the electrical conductors 5 and 7 extend some distance into the envelope 3 which is acceptable for many types of photoflash lamps but detrimental to a subminiature type photoflash lamp due to the limited length of the overall lamp. Also, the relatively long electrical conductors 5 and 7 not only require an additional process step and additional materials to provide a layer of insulating material but also require the removal of a portion of the applied insulating material. All of this in order to inhibit short-circuiting of the electrical conductors 5 and 7 by the adjacent shredded combustible material 19, and to reduce any tendency to undesirably embed the electrical conductors 5 and 7 in the envelope 3.

Figure 2:
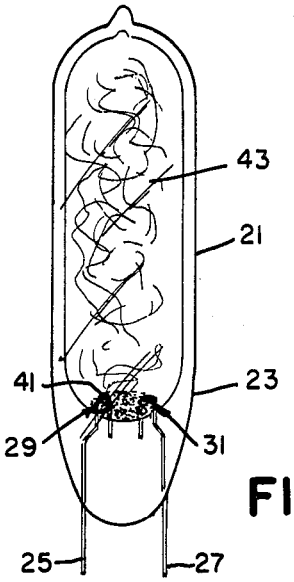
FIG. 2 is an illustration of a preferred form of miniaturized photoflash lamp of the invention.
Figure 3:
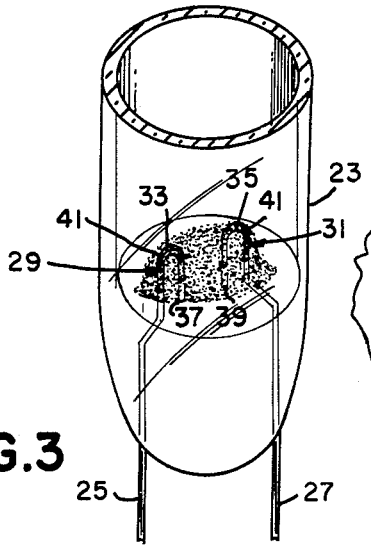
FIG. 3 is an enlarged sectional view of the photoflash lamp of FIG. 2.

FIGS. 2 and 3 illustrate a preferred form of subminiature type photoflash tube 21. Therein, a light transmittable envelope 23, which may be but not necessarily need be of a so-called soft type glass such as G-1 glass, has a coefficient of expansion within the range of about 85 to $95\times10^{-7}$ in/in°C. between 20° and 300° C. The envelope 21 would normally have an outside diameter of about 0.210 inch with a wall thickness of about 0.030 inch and of a length of about 0.700 inch. In all, the photoflash tube 21 would preferably have an internal volume of about 0.12 cubic centimeters.

Figure 4:
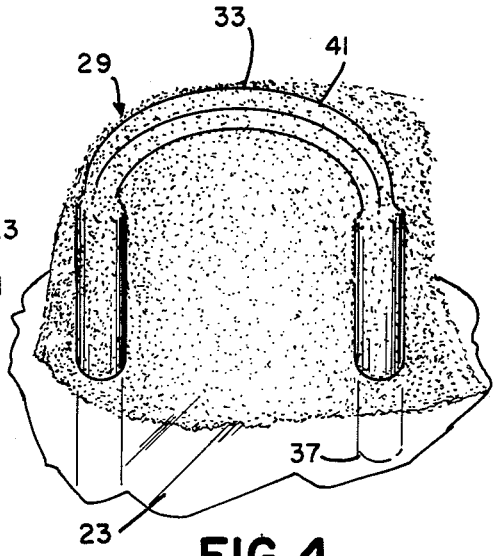
FIG. 4 is an enlarged fragmentary view of a flattened loop portion of one of a pair of electrical conductors of FIG. 3.

At one end 23 of the envelope 21 a pair of electrical conductors 25 and 27 is sealed and pass into the envelope 21. Each of the electrical conductors 25 and 27 extends inwardly of the end 23 of the envelope 21 for a distance in the range of about 0.010 to 0.020 inch. Also, each of the electrical conductors 25 and 27 is bent back upon itself to form a loop 29 and 31 respectively within the envelope 21. Although not a necessary requirement, one or more of the loops 29 and 31 may have a portion 33 and 35 thereof which is flattened to facilitate the desired formation of the loops 29 and 31 (FIG. 4) Also, the ends 37 and 39 of each of the electrical conductors 25 and 27 are preferably embedded into the one end 23 of the envelope 21.

Bridging each of the loops 29 and 31 of the electrical conductors 25 and 27 is a layer of primer material 41. The primer material 41 may be any one of a number of material compositions known in the art. As an example, one specific primer material 41 included about 10% by weight of potassium perchlorate, 5% magnesium, 6% binders and fillers and the remainder zirconium powders. Moreover, the above-described primer material 41 preferably but not necessarily extends intermediate the loops 29 and 31 of the electrical conductors 25 and 27.

Also, a quantity of filamentary combustible fill 43 is disposed within the envelope 21 immediately adjacent the primer material 41. In a preferred embodiment employing the previously described envelope 21 the combustible fill 43 was in the form of about 12 mg. of zirconium shreds measuring $0.0096\times0.0011\times0.005$ inch. Obviously, other sizes and materials known in the art are equally applicable.

Additionally, the envelope 21 has a combustion-supporting gas fill therein which, in this particular instance, is in the form of oxygen at a pressure of about 20 atmospheres. Moreover, a lacquer coating 45 covers the envelope 21 in a manner well known in the art.

Thus, there has been provided a unique miniaturized photoflash lamp having an improved ignition means wherein a pair of relatively short electrical conductors are looped back on themselves to provide a primer material support which is devoid of sharp edges which penetrate the primer material. Also, the looped electrical conductors tend to inhibit glass flow which would undesirably cover and electrically insulate the electrical conductors. Moreover, the looped configuration of the electrical conductors appears to provide enhanced support for the primer material thereon.

While there has been shown and described what is at present considered the preferred embodiments of the invention, it will be obvious to those skilled in the art that various changes and modifications may be made therein without departing from the invention as defined by the appended claims.

I claim:

1. A photoflash lamp having a glass envelope containing a charge of filamentary combustible material and a combustion supporting gas and characterized by the improvement wherein an ignition means is located within said glass envelope adjacent said filamentary combustible material with said ignition means in the form of a pair of electrical conductors each passing through one end and extending inwardly of said glass envelope and bending back upon itself to form a loop with the end portion thereof embedded into said one end of said glass envelope and a primer material substantially bridging said loops of said pair of electrical conductors.

2. The photoflash lamp of claim 1 wherein each of said pair of electrical conductors has a flattened portion forming said loop.

3. The photoflash lamp of claim 1 wherein said glass envelope has an outside diameter in the range of about 0.210 inch and each of said pair of electrical conductors extends inwardly of said one end of said glass envelope for a distance in the range of about 0.010 to 0.020 inch.

4. The photoflash lamp of claim 1 wherein said pair of electrical conductors passing through said one end of said glass envelope are held in spaced relationship by said one end of said glass envelope.

5. The photoflash lamp of claim 1 wherein said pair of electrical conductors passing through and extending inwardly of said one end of said glass envelope are supported in spaced relationship to one another within said glass envelope by said one end of said glass envelope.

6. A photoflash lamp comprising:

a light transmittable envelope;

a charge of filamentary combustible material located within said light transmittable envelope;

a combustion supporting gas contained within said light transmittable envelope; and an ignition means located witin said light transmittable envelope in operative relationship to said filamentary combustible material, said ignition means including a pair of electrical conductors sealed into and passing through one end of said light transmittable envelope with each of said pair of electrical conductors bent to form a loop within said envelope, and a primer material substantially bridging said loops of said pair of electrical conductors.

7. The photoflash lamp of claim 6 wherein said light transmittable envelope has an outside diameter of about 0.210 inch.

8. The photoflash lamp of claim 6 wherein each of said loops of said pair of electrical conductors within said envelope is covered and bridged together by a layer of primer material.

9. The photoflash lamp of claim 6 wherein said loop of each of said electrical conductors within said light transmittable envelope is of a length in the range of about 0.010 to 0.020 inch.

10. The photoflash lamp of claim 6 wherein said loop of each of said electrical conductors includes a flattened portion whereby formation of the loop is facilitated.

11. The photoflash lamp of claim 6 wherein said electrical conductors of said ignition means are held in spaced relationship by said one end of said envelope.

12. The photoflash lamp of claim 6 wherein each of said electrical conductors is bent to form a loop inwardly of said envelope with the end of each of said conductors forming said loop sealed into said one end of said envelope.

* * * * *